US011533981B1

(12) United States Patent
Amis

(10) Patent No.: US 11,533,981 B1
(45) Date of Patent: Dec. 27, 2022

(54) HAIR STYLING DOLL AND ACCESSORIES USED FOR HAIR BRAIDING

(71) Applicant: Natasha Amis, Spring Valley, CA (US)

(72) Inventor: Natasha Amis, Spring Valley, CA (US)

( * ) Notice: Subject to any disclaimer, the term of this patent is extended or adjusted under 35 U.S.C. 154(b) by 515 days.

(21) Appl. No.: 16/263,340

(22) Filed: Jan. 31, 2019

(51) Int. Cl.
*A45D 44/14* (2006.01)
*A63H 3/44* (2006.01)

(52) U.S. Cl.
CPC ..... *A45D 44/14* (2013.01); *A63H 3/44* (2013.01)

(58) Field of Classification Search
CPC . A63H 3/44; A63H 3/003; A63H 3/36; A45D 44/14
See application file for complete search history.

(56) References Cited

U.S. PATENT DOCUMENTS 1,311,066 A * 7/1919 Goldman ..... A63H 3/44 446/394
2,175,693 A * 10/1939 Jacoby ..... A63H 3/44 446/394
3,808,736 A 5/1974 Terzian et al.
3,903,640 A * 9/1975 Dunn ..... A63H 3/44 446/394
5,041,050 A * 8/1991 Ritchey ..... A63H 3/44 446/394
5,121,761 A * 6/1992 Meister ..... A41G 5/0053 132/201
D357,701 S * 4/1995 White ..... D21/659
6,280,281 B1 * 8/2001 Unalp ..... A63H 3/36 446/296
8,746,257 B1 * 6/2014 Holmes ..... A45D 24/00 132/148
9,033,196 B1 * 5/2015 Smith ..... A41G 5/0086 223/102
2006/0141900 A1 * 6/2006 Wesley ..... A63H 3/44 446/394
2007/0155280 A1 * 7/2007 Patean ..... A63H 3/44 446/385
2007/0269772 A1 * 11/2007 Taya ..... A45D 44/14 434/94
2008/0014828 A1 * 1/2008 Kelly ..... A63H 3/50 446/73
2012/0067365 A1 * 3/2012 Brown ..... A41G 5/002 132/201

(Continued)

*Primary Examiner* — Eugene L Kim
*Assistant Examiner* — Alyssa M Hylinski
(74) *Attorney, Agent, or Firm* — Sanchelima & Associates, P.A.; Christian Sanchelima; Jesus Sanchelima

(57) ABSTRACT

The present invention is a hair styling doll comprising a head with attachable synthetic hair used for hair braiding, a shoulder below head to hold doll in upright position, at least one accessory used for making different hair braiding. The accessories comprise parting comb, hairbrush, weaving needle, thread and hair bonding glue. The hair can be short or long and of different color. The doll can be of different color. Hair is attached to baldhead using hair bonding glues. One or more hair extensions can be attached to doll hair using weaving needle and thread. French braids can be braided straight at back or braided by wrapping around head using at least one accessory. Hair after braiding can be removed from doll and can be used in head of user. Hair styling doll can be used by hair training schools, cancer patients or can be used for kid's play.

1 Claim, 4 Drawing Sheets

(56) References Cited

U.S. PATENT DOCUMENTS

| | | | | |
|---|---|---|---|---|
| 2015/0118654 | A1* | 4/2015 | Phillips | A45D 44/14<br>434/94 |
| 2016/0262482 | A1* | 9/2016 | Kim | A41G 5/0026 |
| 2017/0021283 | A1* | 1/2017 | Jones | G09B 21/009 |
| 2017/0120156 | A1* | 5/2017 | Fierro | A63H 3/44 |
| 2018/0035738 | A1* | 2/2018 | Hayes | A41G 5/0046 |
| 2019/0357614 | A1* | 11/2019 | Rangel | A41G 5/0086 |

* cited by examiner

HAIR STYLING DOLL AND ACCESSORIES USED FOR HAIR BRAIDING

II. BACKGROUND OF THE INVENTION

1. Field of the Invention

The present disclosure relates to a hair styling doll. More particularly, the present disclosure relates to a hair styling doll with accessories used for hair braiding.

2. Description of the Related Art

Presently, many hair styling products are in market that allows users to learn or try various hair braiding techniques. Such products are usually a doll with hair that allows hairstyle-teaching schools to easily teach various hairs braiding to students. Doll also allows students to try and practice various hair braids. Also, hair embedment is required for cancer patients.

Applicant believes that a related reference corresponds to US patent application US20100330869A1 filed by Mattel Inc, for hair styling mechanisms and hair styling dolls. The Mattel Inc reference discloses a hair styling doll with a hair styling mechanism that includes a body with a head to which a lock of hair is coupled. The doll includes an adjustment mechanism that can be manipulated to adjust the length and shape or configuration of the lock of hair. The hair is braided, and the adjustment mechanism includes an elongate member that is coupled to the different sections of the braided hair. The elongate member is coupled to the hair in an alternating configuration or pattern such that pulling the elongate member results in the braided hair coiling and forming a bun-like structure.

Another related application is U.S. Pat. No. 3,808,736A filed by Glass Marvin and Associates for a hair styling figure and accessories. The Glass Marvin and Associates reference discloses a hair styling figure, and accessories therefor, which includes a simulated head having a skull portion with hair imbedded therein or fixed thereto. The skull portion has a generally centrally located aperture in the top thereof through which a tuft of simulated hair protrudes and within which one of a plurality of interchangeable accessory pieces may be received in removed condition. The accessory pieces when received in the skull aperture have outwardly protruding portions, which facilitate styling the hair for curling, braiding or other styling arrangements. Once the hair is set by utilizing one of the hairs styling accessory pieces, the particular accessory piece may be removed, if desired, and the hair combed out or otherwise arranged.

Another related application is US patent number US20060141900A1 filed by Theresa Wesley for a Weavee doll. The Theresa reference discloses a child's doll with multiple interchangeable hairpieces, which may be fastened to the doll's scalp to create a variety of hair styles. A fastening material covers the doll's scalp area, and the fastening material may include a conventional Velcro® type loop fastener. A variety of interchangeable cross-cultural accessorized hair pieces are also provided, varied in size, and may chosen from the group consisting of Micro-braids, Senegalese twists, Pixie braids, Bobs, Corn rows, Silk braids, African twists, braids, Individual braids, Flat twists and Straight locks, as well as other ethnic and high-fashion hair pieces. The hair pieces include distal fastening pads (such as Velcro® type hook fasteners) that removably attach to the scalp fastening material. The individual hair pieces may be attached in combination to form a variety of cross-cultural haircuts, colors, textures, braids, twists, weaves, etc. in a variety of styles, cuts, lengths, textures, colors, and so on.

Other documents describing the closest subject matter provide for a number of more or less complicated features that fail to solve the problem in an efficient and economical way. None of these patents suggest the novel features of the present invention.

III. SUMMARY OF THE INVENTION

It is an object of the present invention to provide a hair styling doll. The hair styling doll with accessories can be used for hair braiding. Using hair styling doll and its accessories, user can try various hair braiding techniques and use braided hair on his/her own hair. Hair styling doll can be used by hair training schools, cancer patients or can be used for kid's play.

It is yet another object of the present invention to a hair styling doll comprising a head with attachable synthetic hair used for hair braiding, a shoulder below head to hold doll in upright position, at least one accessory used for making different hair braiding. The accessories comprise parting comb, hairbrush, weaving needle, thread and hair bonding glue. The hair can be short or long and of different color. The doll can be of different color.

It is still another object of the present invention to provide a hair styling doll in which hair is attached to bald head of doll using hair bonding glues.

It is another object of the present invention to provide a hair styling doll in which user can make French braids in doll's hair. French braids can be braided straight at back or braided by wrapping around head using at least one accessory. One or more hair extensions can be attached to doll hair/braided hair using weaving needle and thread.

It is another object of the present invention to provide a hair styling doll in which hair after fully braiding is removed from doll and can be used by other users.

Further objects of the invention will be brought out in the following part of the specification, wherein detailed description is for the purpose of fully disclosing the invention without placing any limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 shows a hair styling doll 10 comprising a shoulder 2, face 8 and a doll head 1 without hair, used for hair braiding.

Figure 5:
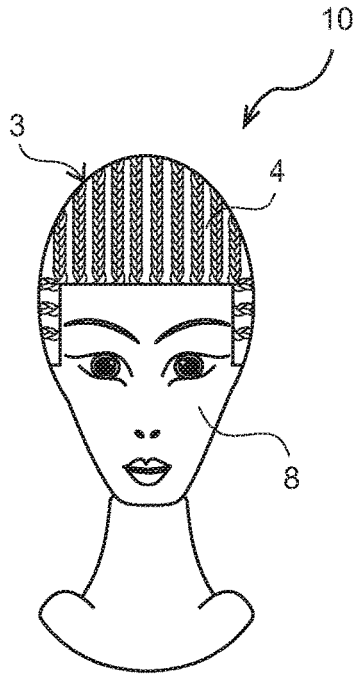
Figure 5A:
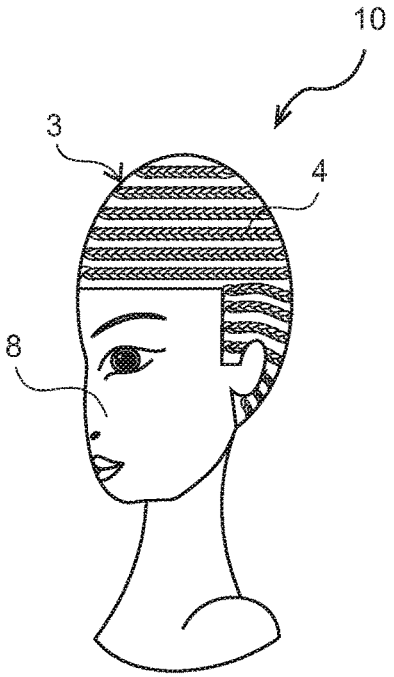
Figure 5B:
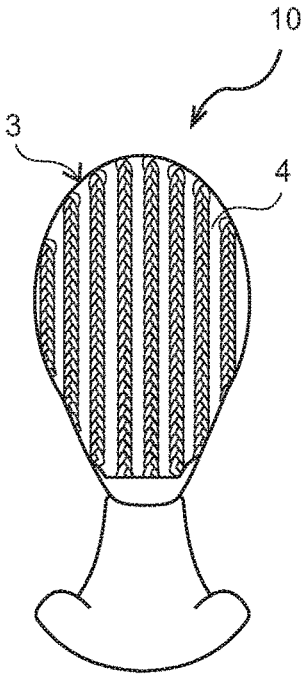

FIGS. 5, 5A and 5B show front, side and back view of hair styling doll 10 showing hair 3 parted and braided in the form of French braids 4. French braids 4 are braided straight at back.

Figure 6:
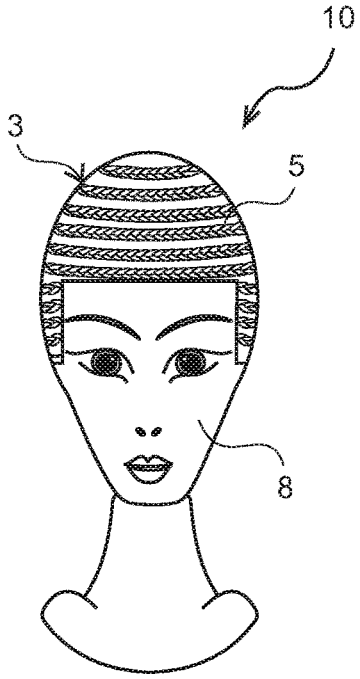
Figure 6A:
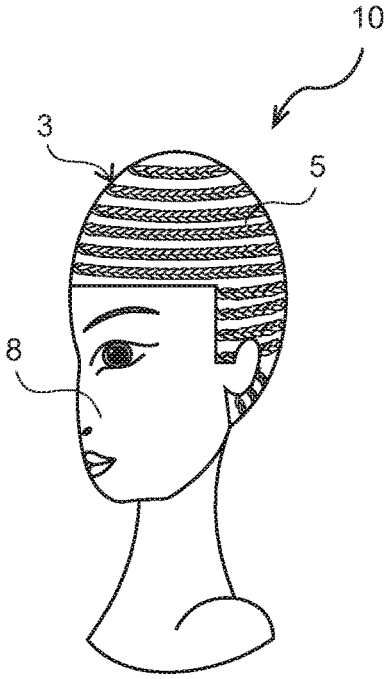
Figure 6B:
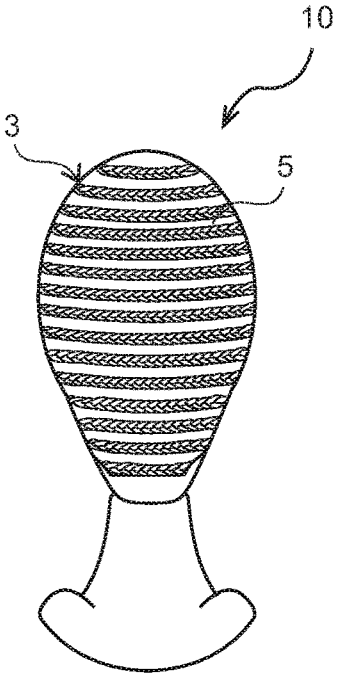

FIGS. 6, 6A and 6B show front, side and back view of hair styling doll 10 showing hair 3 parted and braided in the form of another French braids 5. French braids 5 are braided wrapped around the doll head 1.

Figure 7:
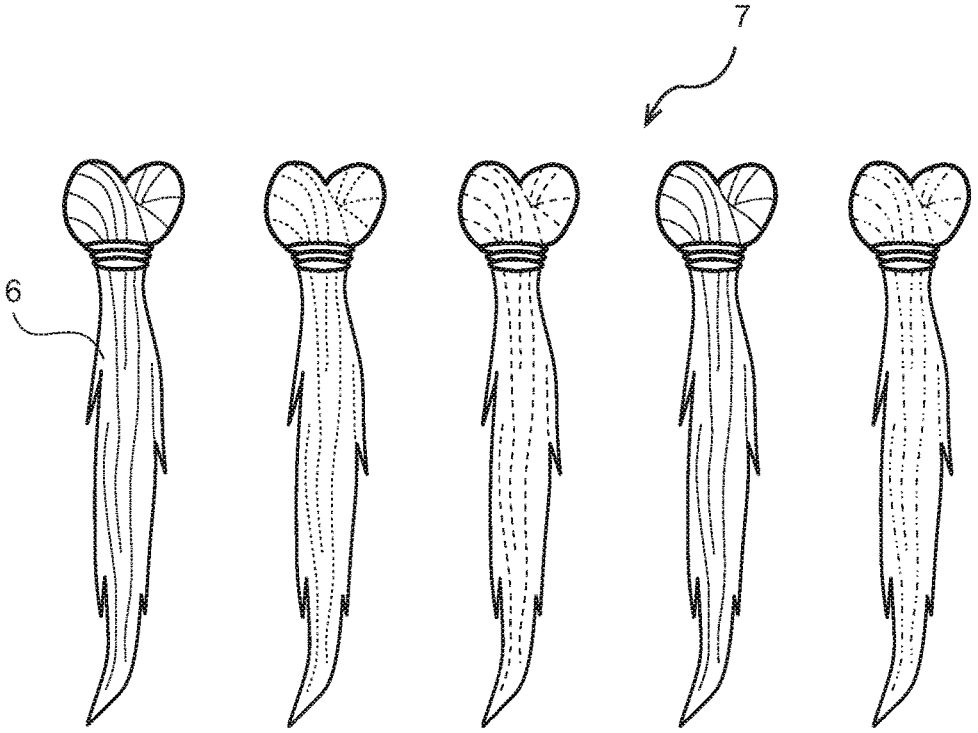

FIG. 7 shows a bundle 7 of synthetic hair extension 6 of various colors that can be attached to braid hair styling doll 10.

Figure 8:
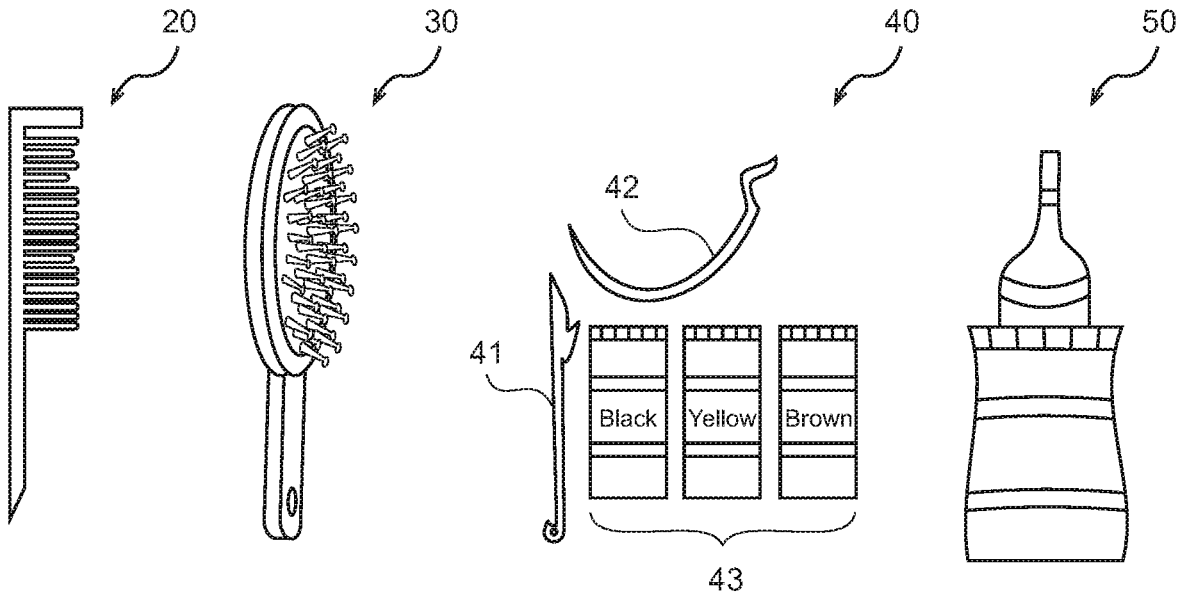

FIG. 8 shows various accessories 20, 30, 40 and 50 used for hair braiding using braid hair styling doll 10.

V. DETAILED DESCRIPTION OF THE EMBODIMENTS OF THE INVENTION

Figure 1:
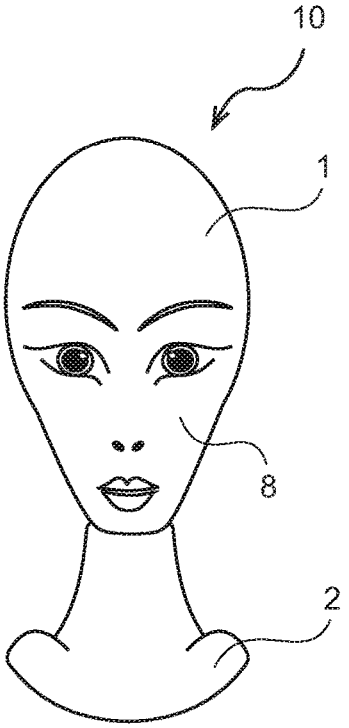

Referring now to the drawings, FIGS. 1-8, where the present invention is generally referred to with numeral 10, that includes hair styling doll 10. FIG. 1 shows a hair styling doll 10 comprising a shoulder 2, face 8 and a doll head 1 without hair, used for hair braiding. Head 1 can be attached with hair, which can used for hair braiding. Shoulder 2 below head 1 is used to hold doll in upright position. Hair styling doll 10 with accessories and attachable hair can be used by hair training schools, cancer patients or kids. Accessories can be parting comb, hair brush, weaving needle and thread and hair bonding glue, without limitations.

Hair training schools can try or learn different types of hair braids using doll 10. Kids can play with doll 10 and can try different types of braids. Cancer patients can attach hair on doll head 1 and can make different types of braids, which can be then used on their head 1. This allows cancer patients/others to make their own hair braids/styles and can easily use them on their/others hair.

Figure 2:
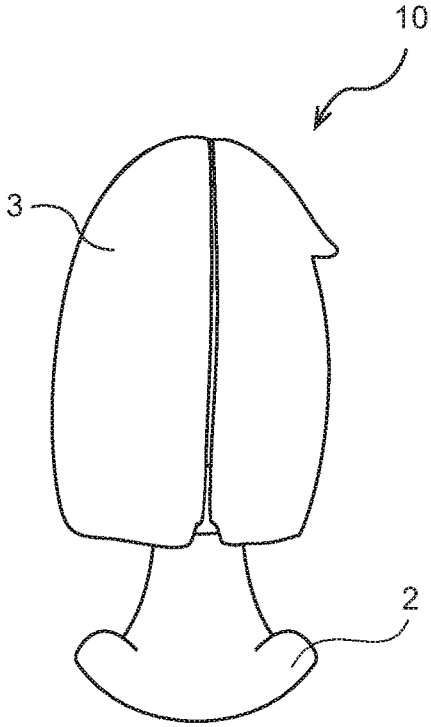
FIG. 2 shows hair styling doll 10 of FIG. 1 with short hair 3, used for hair braiding.

FIG. 2 shows hair styling doll 10 comprising a shoulder 2 and a doll head 1 with hair 3, used for hair braiding. Hair of different color, length or nature can be used. Doll 10 may come with basic hair, a bundle of hair extension and accessories used for parting and braiding hair based on user wish/requirement. Additional accessories, hair of different colors, length or nature and another set of bundles of hair extension can be brought at additional cost. The doll 10 can also be of different color that is similar to user skin, so that they can easily try braids that are suitable to them. In FIG. 2, doll is attached with short hair 3.

Figure 3:
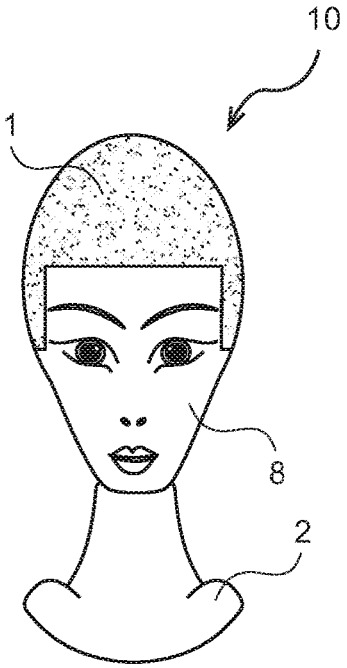
FIGS. 3, 3A and 3B show front, side and back view of hair styling doll 10 with bald head 1.
Figure 3A:
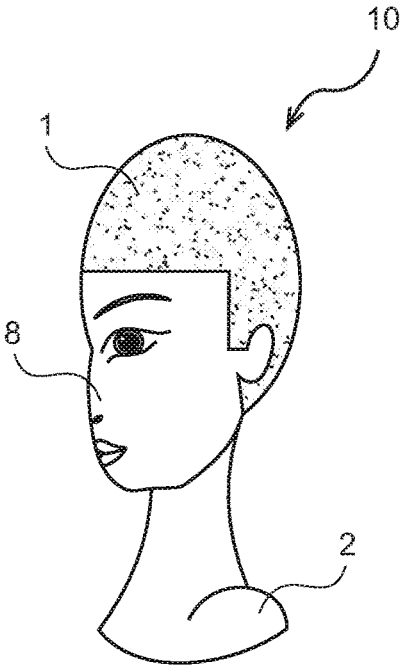
Figure 3B:
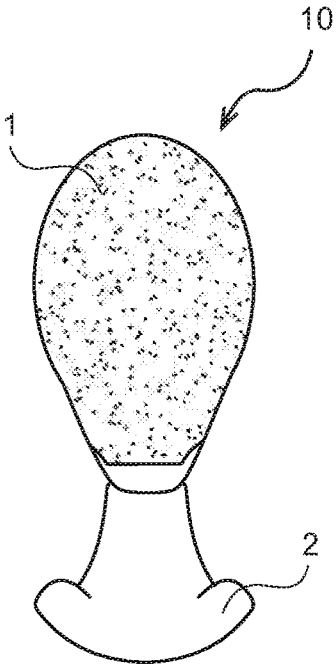
Figure 4:
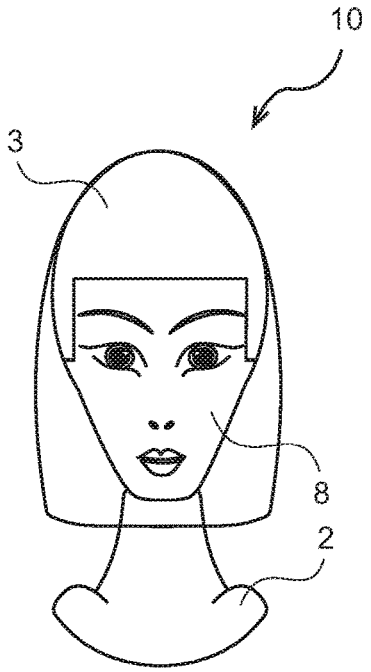
FIGS. 4, 4A and 4B show front, side and back view of hair styling doll 10 with short hair 3.
Figure 4A:
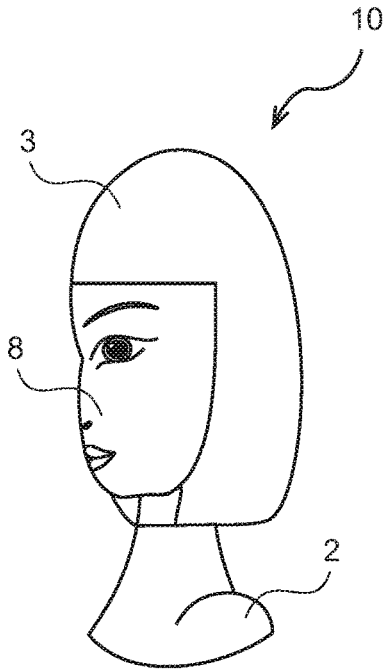
Figure 4B:
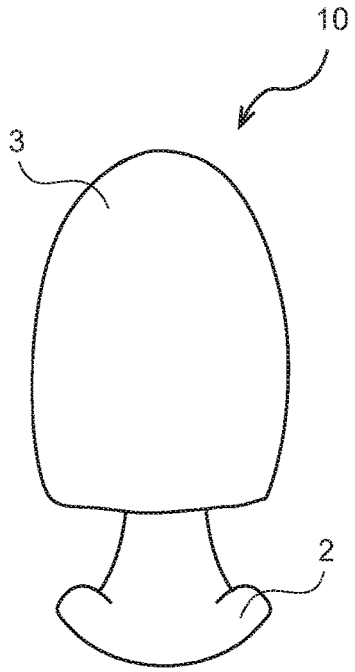

FIGS. 3, 3A and 3B show front, side and back view of hair styling doll 10 without hair or bald head 1. Hair bonding glue (accessory) can be used to attach synthetic hair to bald head 1. Hair can be of different color, length or nature, depending on user requirement/wish. FIGS. 4, 4A and 4B show front, side and back view of hair styling doll 10 with short hair 3 attached to bald head 1 of FIGS. 3, 3A and 3B. Hair styling doll 10 of FIGS. 4, 4A and 4B can be used by hair training schools, cancer patients, and other users. This allows users to train themselves in different hair styles and braids. After braiding, the hair 3 can be used in other users or can be used on their own head.

FIGS. 5, 5A and 5B show front, side and back view of hair styling doll 10 showing hair 3 parted and braided in the form of French braids. French braids 4 are braided straight at back. As shown in FIGS. 6, 6A and 6B French braids 5 are braided by wrapping around the doll head 1. Hair braiding shown in FIGS. 5, 5A and 5B and FIGS. 6, 6A and 6B are not limited to French braids as shown, other hair braiding styles are also possible with doll 10 of present invention.

FIG. 7 shows a bundle 7 of synthetic hair extensions 6 of various colors that can be attached to braid hair styling doll 10. The bundle of synthetic hair extensions 6 can be of different/same color, length or nature, depending on requirement/wish of user. User can buy required additional bundle 7 of synthetic hair extensions 6 according to their requirements.

FIG. 8 shows various accessories 20, 30, 40 and 50 used for hair braiding using braid hair styling doll 10. The various accessories are not limited to hair parting comb 20 used to part hair while hair braiding, regular fine brush 30 used to comb synthetic hair 3 and its extensions 6, weaving needle 41 and 42 and thread 43 used to attached synthetic hair extensions 6 to hair braids, and hair bonding glue 50 used to attach short/long hair 3 to bald head of doll 10.

The present invention allows users to part and braid doll hair easily and train themselves in various hair braids and even use in their own head, if required. Thus, hair styling doll with accessories and hair extensions allows user to create and use various hair braids and make them more beautiful.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hair styling doll, consisting of:

a doll head assembly including a head with hair, wherein said hair is synthetic hair that is removably attached to the head with a hair bonding glue, wherein the synthetic hair includes a squared portion that is located in alignment with a forehead portion of the head, the hair being configured for a user to practice hair braiding, said head being mounted to shoulders, the shoulders including a rounded bottom portion; and an accessory assembly including accessories adapted to be used for hair braiding, wherein the accessories include a parting comb, a hair brush, a first weaving needle, a second weaving needle, a plurality of threads including a black thread, a yellow thread, and a brown thread, a hair bonding glue and a bundle of hair extensions, the parting comb including an elongated handle having a comb top end and a comb bottom end, the comb top end including a series of parallel prongs extending perpendicular to the elongated handle, the comb bottom end including a tapered end, wherein the first weaving needle includes an elongated rod portion, the elongated rod portion having a top end that includes a harpoon tip, the elongated rod portion further including a bottom end that has a hook member extending therefrom, the second weaving needle includes an arcuate rod having a pointed first end and a curved second end, wherein the arcuate rod and the curved second end include oppositely facing curvatures.

* * * * *